US007033103B2

(12) United States Patent
Gort

(10) Patent No.: US 7,033,103 B2
(45) Date of Patent: Apr. 25, 2006

(54) MARKING ASSEMBLY FOR THE MARKING OF PARTICULAR TRAFFIC SITUATIONS AND OBJECTS

(75) Inventor: Marcel Peter Gort, Schellingwouderdijk 241, 1023 NG, Amsterdam (NL)

(73) Assignee: Marcel Peter Gort, Amsterdam (NL)

( * ) Notice: Subject to any disclaimer, the term of this patent is extended or adjusted under 35 U.S.C. 154(b) by 0 days.

(21) Appl. No.: 10/257,803

(22) PCT Filed: Apr. 17, 2001

(86) PCT No.: PCT/NL01/00302

§ 371 (c)(1),
(2), (4) Date: Oct. 15, 2002

(87) PCT Pub. No.: WO02/090664

PCT Pub. Date: Nov. 14, 2002

(65) Prior Publication Data

US 2003/0101628 A1 Jun. 5, 2003

(51) Int. Cl.
*E01F 9/00* (2006.01)

(52) U.S. Cl. ..... 404/9; 404/71; 40/427; 40/446; 40/612; 116/63 R

(58) Field of Classification Search ..... 404/1, 404/9, 14, 71; 359/515, 516, 552; 116/63 R; 40/427, 446, 612
See application file for complete search history.

(56) References Cited

U.S. PATENT DOCUMENTS 1,475,430 A * 11/1923 Curwen ..... 40/454
2,007,524 A * 7/1935 Emmons ..... 116/63 R
2,674,156 A * 4/1954 Mahler ..... 359/465
2,783,730 A * 3/1957 Robins ..... 116/63 R
3,082,560 A * 3/1963 Elvestrom ..... 40/437
3,562,941 A * 2/1971 Boden ..... 40/437
3,742,631 A * 7/1973 Hasala ..... 40/437
4,034,555 A * 7/1977 Rosenthal ..... 368/232
4,249,832 A 2/1981 Schmanski
4,420,221 A 12/1983 Sparks
4,935,335 A * 6/1990 Fotland ..... 430/324
4,944,572 A 7/1990 Young (Continued)

FOREIGN PATENT DOCUMENTS

DE 389 497 C 2/1924

(Continued)

*Primary Examiner*—Gary S. Hartmann
(74) *Attorney, Agent, or Firm*—Hoffmann & Baron, LLP

(57) ABSTRACT

A marking assembly for the marking of particular traffic situations and objects comprises a front row of viewing openings, which are separated from one another by view obstacles (5), at least one back row of view obstacles (6), which are provided at a distance from one another, the view obstacles (5) of the front row contrasting with respect to the view obstacles (6) of the back row. Distances between the viewing openings in the front row and distances between the view obstacles (6) of the back row are so small that a plurality of viewing openings in the front row and a plurality of view obstacles (6) of the back row lie within the field of view of the traffic participant. The field of view of the traffic participant at the same time offers a view, via the plurality of viewing openings in the front row, of an interference pattern of contrasting view obstacles (6), which are covered to a greater or lesser extent by the view obstacles (5) of the front row, of at least one of the back rows.

22 Claims, 11 Drawing Sheets

U.S. PATENT DOCUMENTS

| | | | | | |
|---|---|---|---|---|---|
| 5,161,979 | A | * | 11/1992 | Sekiguchi | 434/365 |
| 5,237,449 | A | * | 8/1993 | Nelson et al. | 359/532 |
| 5,901,484 | A | * | 5/1999 | Seder | 40/488 |
| 6,059,414 | A | * | 5/2000 | Tsai | 359/516 |
| 6,226,907 | B1 | * | 5/2001 | Conley et al. | 40/454 |
| 6,385,882 | B1 | * | 5/2002 | Conley et al. | 40/454 |
| 6,553,699 | B1 | * | 4/2003 | Edmunds et al. | 40/624 |

FOREIGN PATENT DOCUMENTS

| | | | |
|---|---|---|---|
| DE | 22 52 847 | B | 5/1974 |
| DE | 195 23 544 | A | 1/1996 |
| DE | 296 12 851 | U | 10/1996 |
| DE | 198 06 556 | A | 8/1999 |
| EP | 0 118 323 | A | 9/1984 |
| FR | 2 532 095 | A | 2/1984 |

* cited by examiner

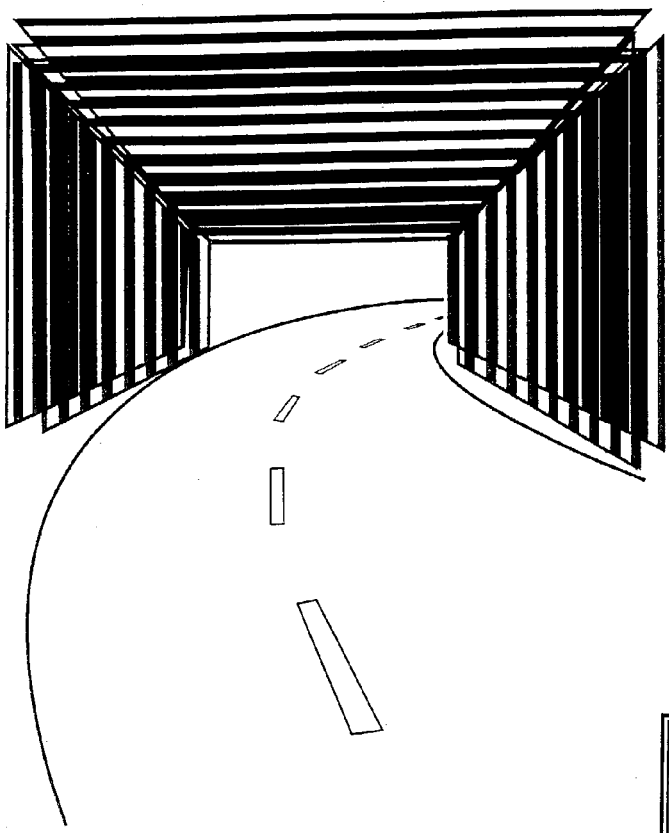
Fig 21
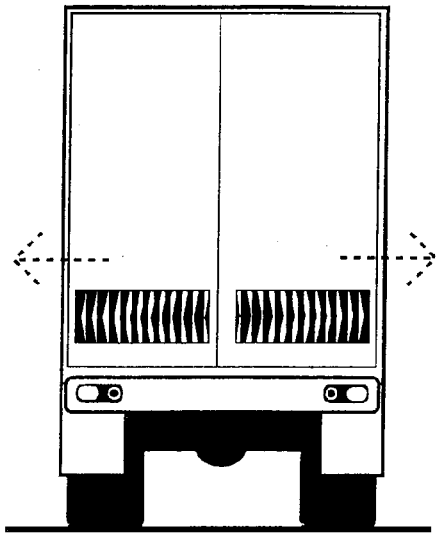
Fig 22
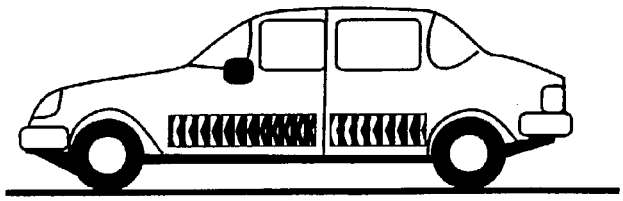
Fig 23
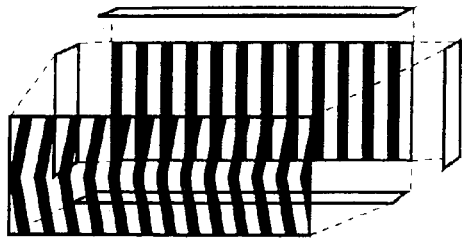

MARKING ASSEMBLY FOR THE MARKING OF PARTICULAR TRAFFIC SITUATIONS AND OBJECTS

CROSS-REFERENCE TO RELATED APPLICATIONS

This application is the national stage filing under 35 U.S.C. §371 of PCT/NL01/00302, filed Apr. 17, 2001, which claims priority to NL 1014940, filed Apr. 13, 2001, both of which are incorporated herein by reference.

BACKGROUND OF THE INVENTION

The invention relates to a marking assembly for forming a specific, desired visual warning for a traffic participant.

Car drivers, motorcyclists and other traffic participants are currently guided through the ever increasing weight of traffic by various visual means. The range of visual means is very extensive and includes, inter alia, traffic lights, traffic signs, reflector posts and lines and arrows arranged on the road surface. So-called eye deceivers, which give a car driver the impression of, for example, driving at very high speed, are also known. Eye deceivers of this type are known, for example, as a succession of posts which are positioned at increasingly short intervals from one another alongside the road or stripes positioned on the road surface.

A drawback of these known means is that they provide substantially static visual warnings. The visual means provided alongside or on a road pass the travelling car driver at the same speed as the rest of the environment. The attention drawn by the marking assembly used is primarily sought by providing the strongest possible contrast with the background.

Furthermore, marking assemblies are known which can be used to provide dynamic visual warnings, in particular by using electricity.

DE-A-198 06 556 discloses a marking assembly according to the preamble of claim 1. This document shows a wall which is arranged at the side of a roadway and in which viewing slots are left open. Image carriers are positioned at an angle behind the wall. A traffic participant moving past the wall can always only see one image carrier. On account of his own speed, this image carrier is removed again from his field of view, after which he can see the next image carrier via the next viewing slot. In this way, depending on the speed of the traffic participant, it is possible to achieve the effect of a film.

A drawback of this arrangement is that it is necessary for the traffic participant to pass a large number of viewing slots and image carriers, i.e. a great length of wall, before he has seen a few seconds of film. This length is often not available in the event of suddenly arising particular situations and objects in the traffic, and moreover the attention of the traffic participant would be diverted from the rest of the traffic for an excessively long time. In the case of drivers, this soon leads to very dangerous situations. Moreover, a high speed of the traffic participant is required in order to produce the effect of a film. This means that the assembly described in DE-A-198 06 556 is primarily suited to applications alongside the railway, i.e. for more passive train and underground passengers.

SUMMARY OF THE INVENTION

The object of the present invention is to provide a marking assembly in which the abovementioned drawbacks are eliminated and in which traffic participants are provided with a visual warning, in a new and surprising way, which can guide them past particular, possibly dangerous traffic situations and objects.

This object is achieved by a marking assembly according to claim 1. In this assembly, at least two rows of view obstacles positioned at a distance from one another are provided. The view obstacles satisfy a number of conditions. The view obstacles from the front row provide a contrast with respect to those from the back row, so that they can be clearly differentiated from one another. Furthermore, the rows are positioned at different distances from the traffic participant. The viewing openings in the front row are positioned closely together. The back view obstacles are likewise positioned closely together. The term closely is understood as meaning that there are a plurality of viewing openings within the same field of view of the traffic participant, together at least providing a view of a plurality of contrasting view obstacles, which are covered to a greater or less extent, from the back row or rows. The contrast differences together with the specific positioning of the rows of view obstacles according to the invention advantageously mean that a traffic participant who looks in perspective between the front view obstacles sees an interference pattern of back view obstacles. This interference pattern has the character of a wave motion. The wave motion draws the attention of a traffic participant in a manner which provides advantageous direction. It is thus possible to have a positive influence on the behaviour of the traffic participant. The marking assembly according to the invention has the considerable advantage that the visual warning which is produced in this way is visible to both a stationary observer and a moving observer. Only a short length of the rows of view obstacles is required for the assembly to operate successfully.

The rows of view obstacles may stand either on a straight line or in an arc of a circle or some other profile. Straight rows of view obstacles can be positioned at different angles with respect to the traffic participant. By using the assembly on, for example, a bend, the visual warning can, as it were, guide a driver through the bend. The traffic participant will instinctively adapt his speed and steering movements to the visual warning. The visible interference pattern explores, as it were, the bend for him, therefore providing certainty about the line to be followed over the course of the bend, without constantly causing a shock, as is the case with suddenly occurring traffic signs. In practice, it has been found that the visual warning provided by the assembly according to the invention retains the attention of the traffic participant for a very long time. The assembly can be produced inexpensively, is not susceptible to faults and can operate without a power source.

The visible interference pattern which can be achieved with the assembly according to the invention can be advantageously influenced by varying the various parameters, such as the distance between the view obstacles from a row, the distance between the rows, the dimensions of the view obstacles, the provision of more than two rows, etc. The invention can be used in a very wide range of situations, particularly where safety aspects play a role, such as in bad weather or in the dark. It is also possible to clearly mark exit slip roads, access slip roads, asynchronously running bends, narrowings in the road, short crawler lanes, vehicles, tunnels and temporary situations, such as roadworks, etc.

The view obstacles from the different rows may be of the same width and at the same distance from one another. In that case, the interference pattern which is displayed is independent of the position of the observer and, as it were, moves with the observer. In other words, the pattern moves with the observer irrespective of the speed at which he is travelling.

Advantageously, however, the distance between the viewing openings in the front row is not equal to the distance between the view obstacles from a back row. This provides a dynamic visual warning to an observer moving past the marking assembly. If the distance between the view obstacles from the front row is, for example, greater than the distance between the view obstacles from the back row, the interference pattern moves more quickly than the observer. If the distance between the view obstacles from the front row is shorter than the distance between the view obstacles from the back row, the interference pattern moves more slowly than the observer, as it were in the opposite direction to the direction of travel of the traffic participant. The speed at which the interference pattern moves with respect to the observer is dependent both on the relative difference in distance between the view obstacles and on the speed of movement parallel to the rows. It is therefore possible to make desired visual effects dependent on the speed of the traffic participant. By way of example, an excessively high speed may be linked to a rapidly moving interference pattern in the opposite direction. This promotes driving more slowly at roadworks, road narrowings, etc. Steering into a bend too late can be indicated by an interference pattern moving in the direction of the bend.

Under most circumstances, it is ideal if the width of the view obstacles and viewing openings from the front row are substantially equal to one another. A smaller width of these view obstacles would provide greater visibility of the back view obstacles, resulting in reduced contrast. A greater width of these view obstacles would result in reduced visibility of the back view obstacles and therefore less modulation.

The interference pattern is an alternation of visibility of the view obstacles from a back row. The front row of view obstacles is visible at all times. Therefore, it is preferable to make the front view obstacles as inconspicuous as possible. Moreover, these view obstacles are less disruptive if they are relatively narrow and are positioned closely together. However, they must not follow one another too closely, since this makes the interference pattern invisible to some people. The back view obstacles should contrast as much as possible with the background and with the front view obstacles. By using a colour contrast between the background and the back view obstacles, the effect also works in daylight.

The contrast is also dependent on the width of the back view obstacles. These are preferably of the same width as the viewing openings and view obstacles from the front row. In that case, the front view obstacles will alternately cover the back view obstacles completely, partially or not at all. The interference pattern then varies between only the background being visible and only the back view obstacles being visible.

The wavelength of the interference pattern is defined as the distance between a back view obstacle from a specific row with minimum visibility and a back view obstacle from the same specific row with maximum visibility. The wavelength is dependent on the distances between the view obstacles from a specific row and on the relative distance between the rows. The greater the distance, for example, between the view obstacles from one row, the longer the wave. The smaller the difference in distance between the rows with respect to the observer, the longer the wave. A desired wavelength can therefore be selected by choosing suitable parameters. The wavelength must not be too great, on account of the deterioration in visibility.

The effects as described above in each case relate to one horizontal line from the field of view of an observer for a specific choice of parameters of rows of view obstacles. By varying the vertical shape of the view obstacles, it is possible to achieve additional effects. By providing the view obstacles with, for example, a bent shape, it is possible to achieve an interference pattern of moving arrow shapes. By positioning the view obstacles from the rows at different angles, it is possible to produce the effect of an interference pattern which is moving upwards or downwards. Differences in contrast are possible by designing the view obstacles to be thicker or thinner on a local basis.

Further preferred embodiments of the invention are defined in the subclaims.

The invention also relates to an independently positionable unit of a frame in which there is a marking assembly according to the invention, as defined in claim 13.

BRIEF DESCRIPTION OF THE DRAWINGS

The invention will be explained in more detail with reference to the appended drawing, in which:

FIG. 21 shows a use in a tunnel wall;

FIG. 22 shows a use on the back of a lorry;

FIG. 23 shows a use on the side of a car;

DETAILED DESCRIPTION THE INVENTION

Figure 1:
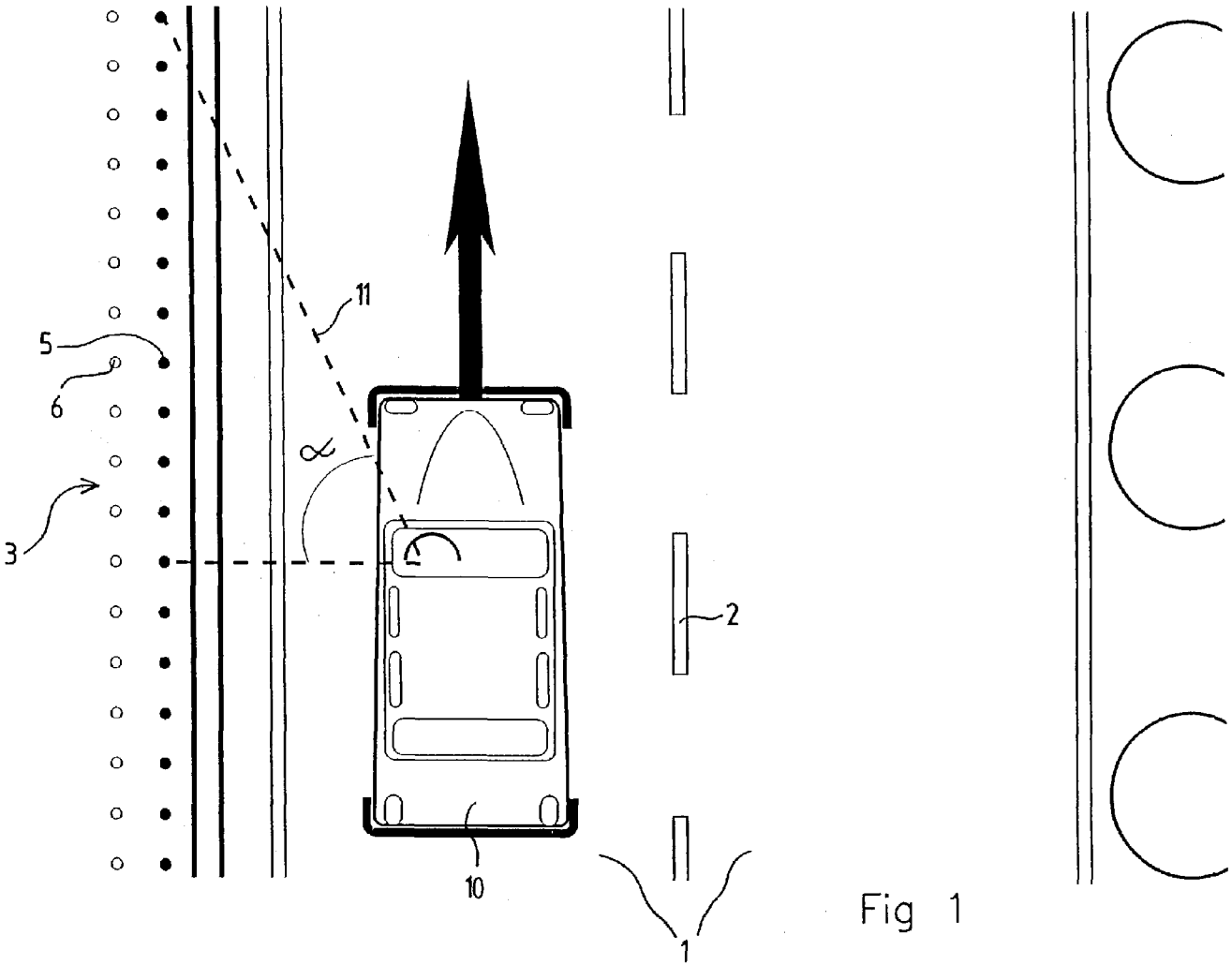
FIG. 1 shows a diagrammatic plan view of a road along which a marking assembly according to the invention is positioned.
Figure 2:
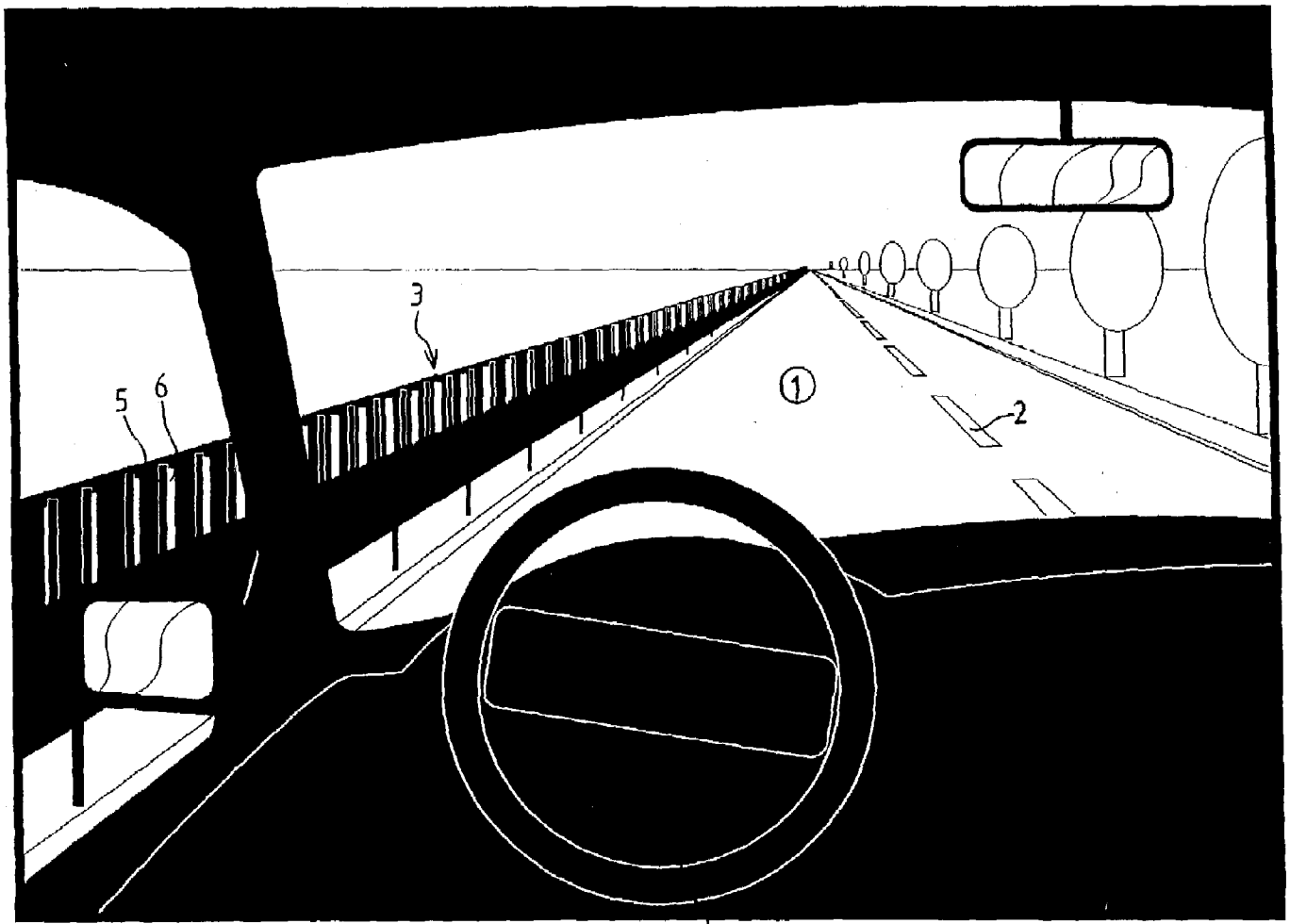
FIG. 2 shows a perspective view of FIG. 1.

FIG. 1 shows a road with two carriageways 1 and a central road axis 2. A marking assembly 3 according to the invention is positioned in the left-hand verge. The marking assembly 3 comprises a first row of posts 5 and a second row of posts 6. The posts 5 are in this case black, and the posts 6 are white, so that they clearly contrast with one another. Other combinations of colours and/or materials are possible. Otherwise, in this embodiment the posts 5, 6 are of virtually identical design. The posts 5 are positioned at a constant distance from one another in a line which is substantially parallel to the road axis 2. The posts 6 are also positioned at a constant distance from one another in a line which is substantially parallel to the road axis 2. The width of the posts 6 is smaller than the distance between two posts 5. In particular, the width of the posts 6 is less than half the distance between the posts 5. A car 10 is travelling on the left-hand carriageway 1. The eyes of the driver of the car 10 have within their range a specific part of the marking assembly 3. The fact that the driver is looking in perspective along the two rows of posts 5, 6 means that he encounters a situation in which the front row of black posts 5 covers the back, white posts 6 to a greater or lesser extent. He perceives, as it were, an interference pattern of narrower and wider white posts 6. The fact that people have a relatively large field of view means that this effect also occurs when the driver is moving. The interference pattern moves, as it were, in the direction of travel together with the driver. Furthermore, the effect is to a large extent independent of the direction of view.

Figure 3:
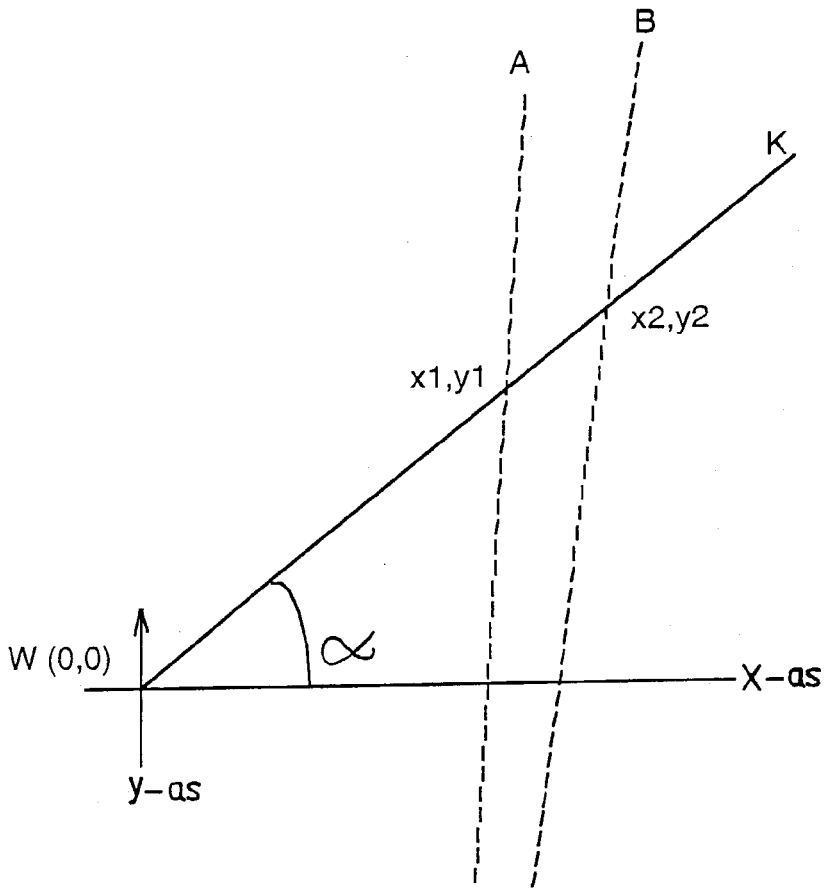
FIG. 3 shows a graph representing a line of view along two rows of view obstacles.
Figure 4:
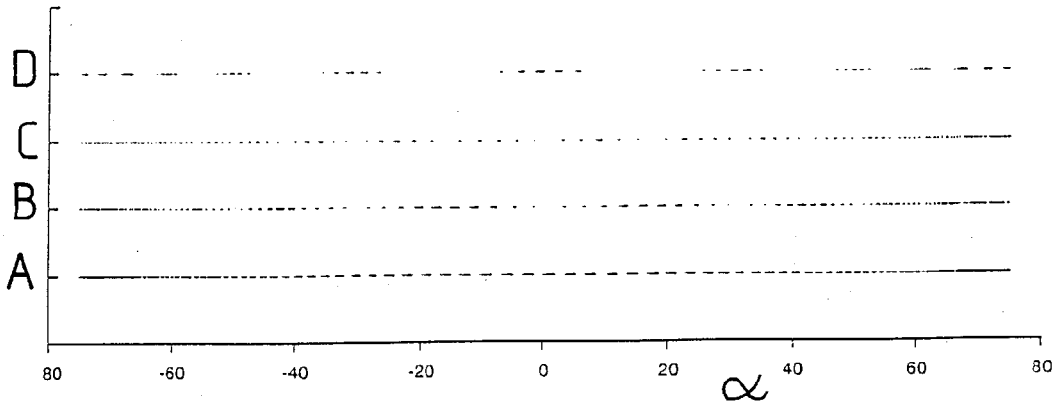
FIG. 4 shows a graph illustrating an interference pattern as is obtained with an assembly according to the invention with four rows of view objects, as seen by a stationary observer.

FIGS. 3 and 4 will now be used to indicate how the observed image can be calculated for a marking assembly with two straight rows of posts A, B with fixed distances between the posts and fixed post widths. In FIG. 3, an observer W is positioned at the origin of an X-Y system of axes. At a certain distance to the right of the observer are, in succession, a first row of posts A and a row of posts B which lies behind the first row. Each angle $\alpha$ has an associated line of view K from the observer for which the extent of visibility of a post B will be calculated. The complete observed image is obtained by varying the angle $\alpha$ for the line of view K in a large number of steps. The lines A and B are at an angle with respect to the X axis and are described by the formulae $Y=a1\ X+b1$ and $Y=a2\ X+b2$. The posts A, B along the lines are at fixed distances P1 and P2 from one another and have a width p1 and p2, respectively. To determine what can be seen along the line of view K, the intersections of the lines A, B with the line K are calculated. The distances of the intersection points X1, Y1 and X2, Y2, respectively, from the X axis can be calculated with the aid of the intersections which are found. This distance determines whether a post A or B is visible at the position X1, Y1 or X2, Y2.

The results of the calculations are plotted in FIG. 4 as a function of the angle $\alpha$. An angle $\alpha$ equal to 0° is in this case perpendicular to the Y axis in FIG. 3, i.e. the observer who is moving forwards along the Y axis is looking sideways at right angles. The illustration in FIG. 4 is not restricted to two rows of posts A and B, but rather is extended by further rows of posts C, D which lie behind rows A and B. It should be noted that the illustration in FIG. 4 is associated with calculations carried out for rows of posts A, B, C and D which extend in a direction which is parallel to the Y axis. The distance between the posts A, B, C and D is identical for each row. The widths of the posts A, B, C and D are also the same for each row. The assumption here is a distance P between the posts of approximately 0.3 meter, and a post width p of approximately 0.15 meter. The rows of posts A, B, C and D are successively positioned at 5, 5.5, 6 and 6.5 meters from the Y axis. FIG. 4 clearly shows an interference pattern of visibility of posts B, C and D. For this variant, the interference pattern can be summarized as a wave motion which dies out. The row of posts A is indicated as seen in perspective, i.e. they will be seen as increasingly small as the distance from the observer increases.

Figure 5:
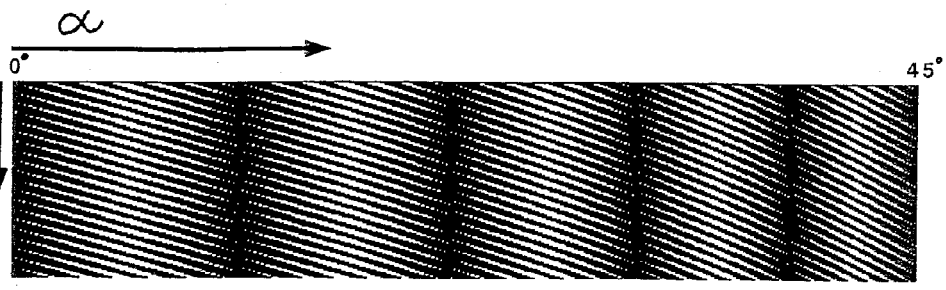
FIGS. 5–7 are space-time diagrams of stationary and moving interference patterns.

FIG. 5 represents an example of a calculated wave pattern for two rows of posts parallel to a carriageway. The front posts and the background are chosen to be black, while the back posts are chosen to be white. The posts from the two rows are of the same width and are at the same distance from one another. The figure is what is known as a space-time diagram. The viewing direction from the observer is plotted along the horizontal axis. 0° corresponds to a viewing direction at right angles to the rows of posts. The time is plotted in the vertical direction. Each row of pixels corresponds to a moment in time, with intervening intervals of 2 milliseconds at a speed of 27 meters/second. As can be seen, a wave pattern which moves with the observer is formed. It should be noted that the interference pattern is more clearly visible as the separate posts become less easily distinguishable.

Figure 6:
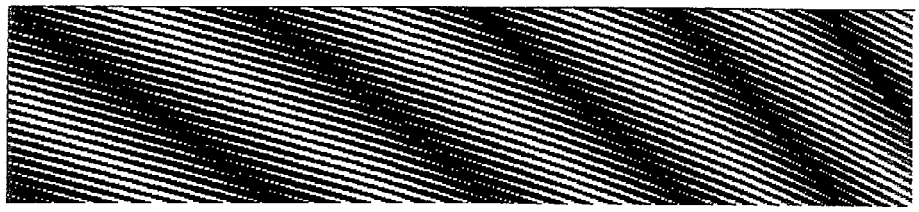

FIG. 6 shows the space-time diagram for the situation in which although the posts from the two rows are of equal width, the distance between the front posts is 1% greater than the distance between the back posts. The result is that a wave which moves more quickly than the travelling observer is formed.

Figure 7:
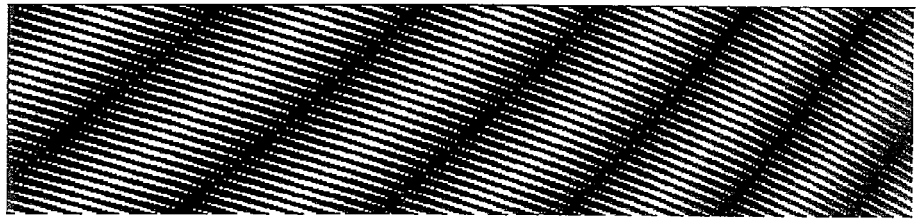

FIG. 7 shows the space-time diagram for the situation in which although the posts from the two rows are of equal width, the distance between the front posts is 1% smaller than that between the back posts. The result is that a wave which moves more slowly than the travelling observer is formed.

Figure 8:
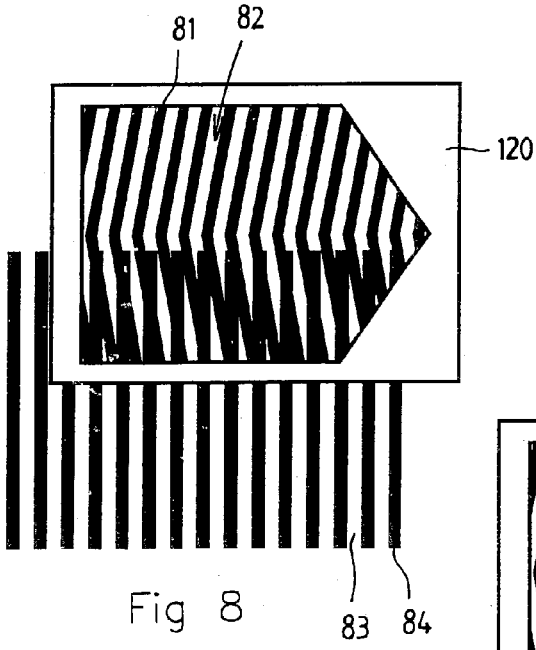
FIGS. 8, 9 and 10, 11 show arrow-shaped designs with moving arrow-shaped interference patterns.
Figure 9:
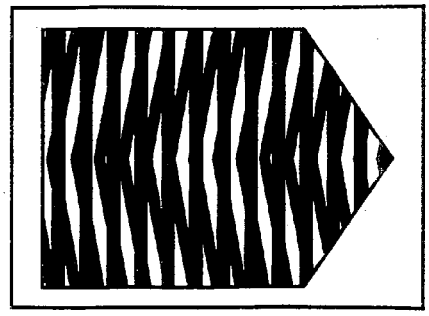

In FIG. 8, a row of front view obstacles 81, in this case formed by black stripes on a transparent sheet 82, are bent to the left in the centre. A back row of view obstacles 83 is in this case formed by white stripes on a black background sheet 84. The front, black view obstacles 81 are designed to be of the same width as the viewing openings of the transparent sheet 82 which are left clear between them. The back, white view obstacles 83 are designed to be of the same width as the black background strips of the background sheet 84 which are situated between them. The back, white view obstacles 83 are of a greater width than that of the front, black view obstacles 81. Positioning the two sheets 82, 84 at a distance one behind the other results in the formation of a marking assembly with an interference pattern as shown in FIG. 9. The figure shows that an interference pattern of white arrows pointing to the left is formed. If an observer moves to the right along the assembly, the white arrows will move more slowly to the right.

Figure 10:
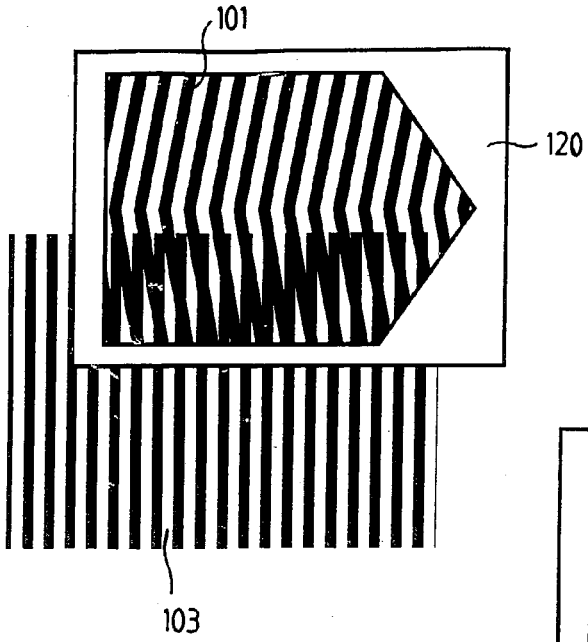
Figure 11:
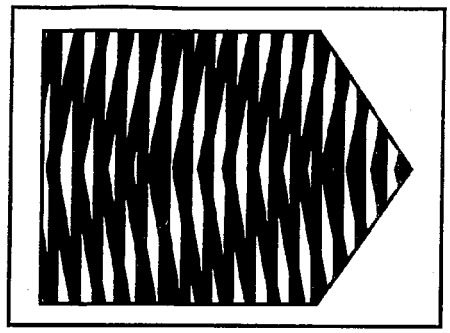

In FIG. 10, the back, white view obstacles 103 are designed to be of a width which is smaller than the width of the front, black view obstacles 101. The marking assembly is otherwise identical. It can be seen in FIG. 11 that an interference pattern of white arrows pointing to the right is formed. If an observer moves to the right along the assembly, the white arrows will move more quickly to the right.

Figure 12:
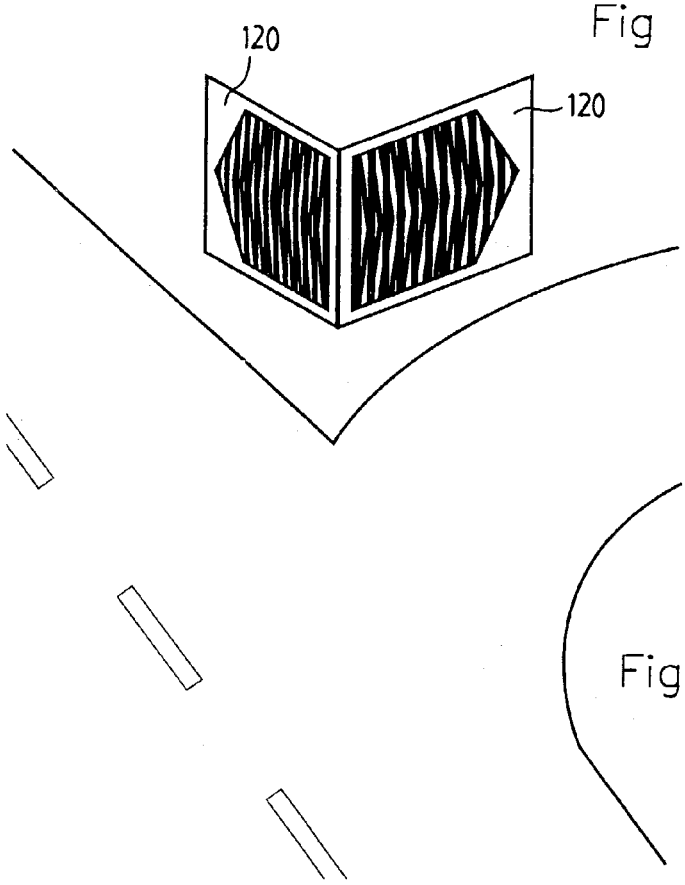
FIG. 12 shows a use of the variants from FIGS. 8–11 at a fork in the road.

The exemplary embodiments shown in FIGS. 8–11 may advantageously be used to make someone brake or accelerate, for example in a bend (cf. FIG. 12).

Advantageously, the front row of view obstacles is provided with a border 120. This isolates the movement of the interference pattern which is formed when an observer moves past the assembly. As a result, the attention of the observer is diverted less quickly by the environment. Moreover, the border 120 is provided with a suitable arrow shape which additionally points the observer in the right direction.

Figure 13:
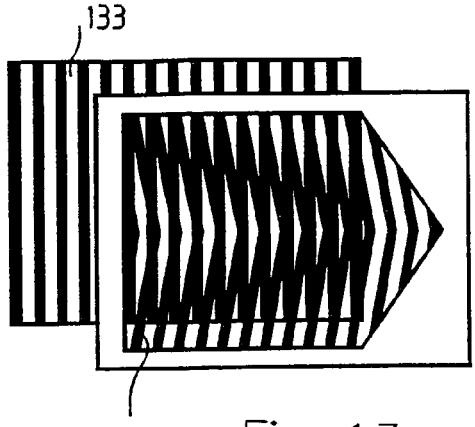
FIG. 13 shows a variant which is bent in the opposite direction to that shown in FIG. 8.

In FIG. 13, the bent shape of the front row of view obstacles 131 is bent the other way. Since, moreover, the distances between the view obstacles 133 from the back row is greater than the distances between the view obstacles of the front row, white arrows which point to the right are now formed, and these arrows will move more slowly to the right than an observer moving to the right past these arrows.

Figure 14:
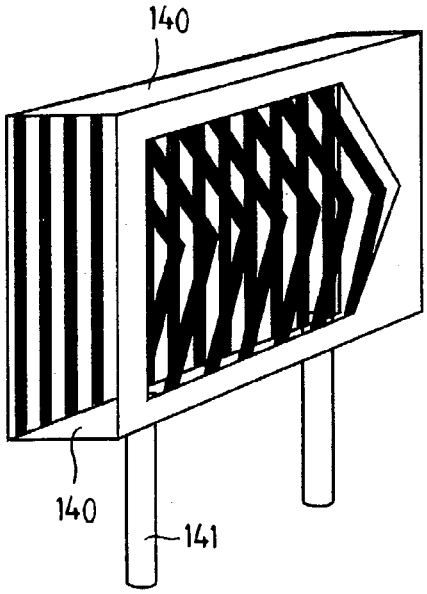
FIG. 14 shows a use of the variant from FIG. 13 in a frame unit provided with legs.

FIG. 14 shows the assembly from FIG. 13 with top and bottom walls 140 in between, which connect the front and back sheets to one another. Moreover, the assembly is positioned on legs 141, so that it can be arranged at any desired location.

Figure 15:
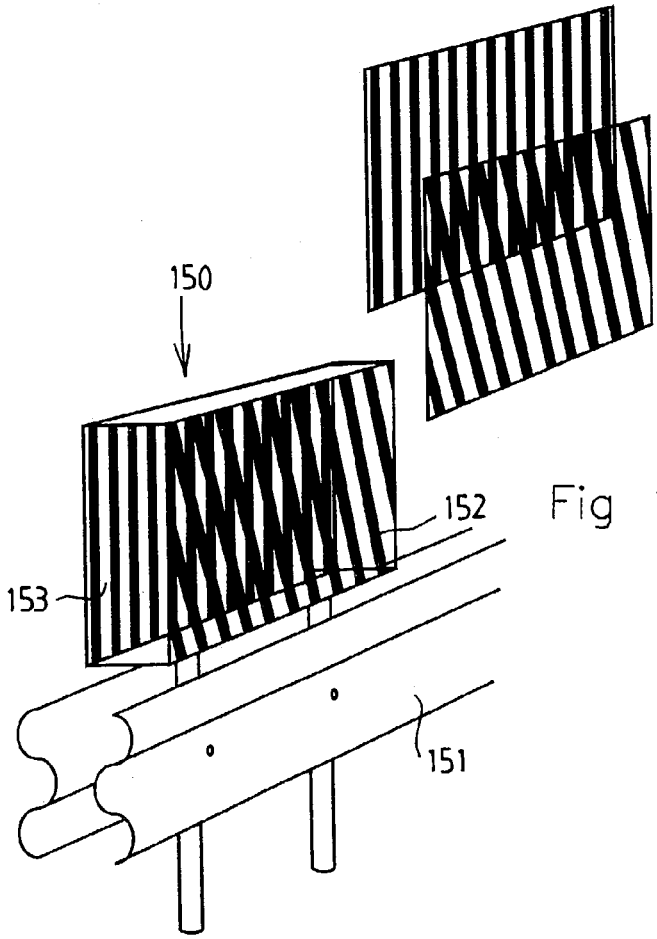
FIG. 15 shows a use of a frame unit on top of a crash barrier.

FIG. 15 shows a marking assembly 150 which is arranged on the top of a crash barrier 151. The assembly comprises a first row of view obstacles 152 which are arranged at an angle, and a second row of vertical, contrasting view obstacles 153. For an observer moving past the assembly, an interference pattern which moves upwards or downwards is formed. This can be used, for example, as a warning of bumps or slopes in the road surface.

Figure 16:
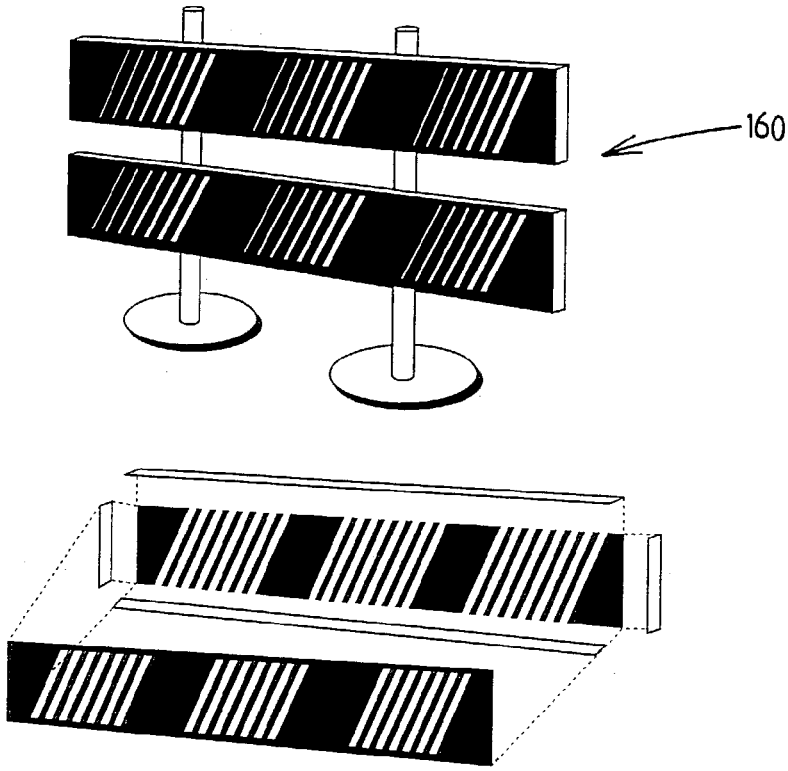
FIG. 16 shows a use in a barrier.
Figure 17:
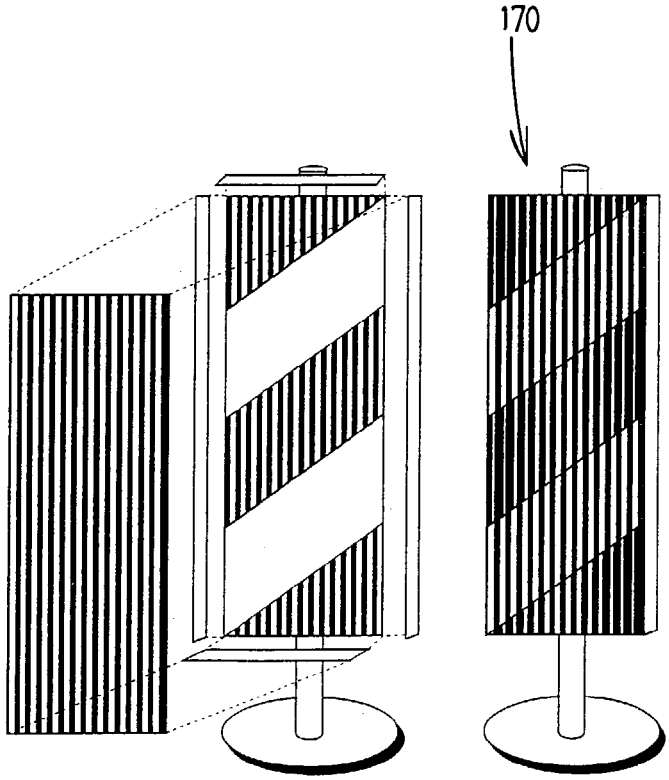
FIG. 17 shows a use in an upright.
Figure 18:
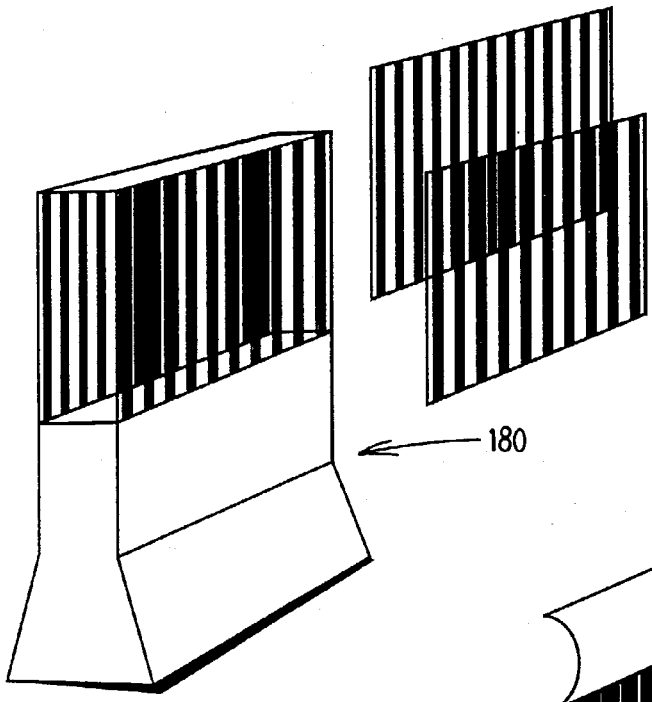
FIG. 18 shows a use on top of a temporary road divider.
Figure 19:
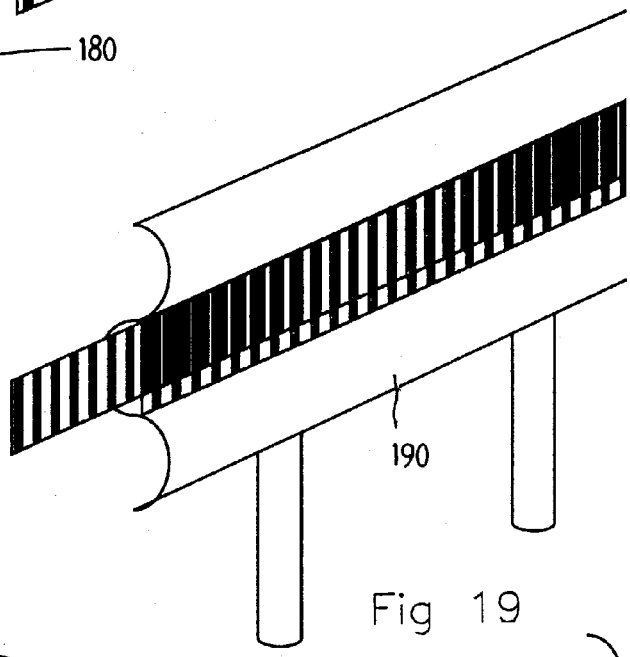
FIG. 19 shows a use in a crash barrier.

The invention may advantageously also be used in existing road markings, such as the barrier 160 in FIG. 16, the upright 170 in FIG. 17, the concrete emergency road separator 180 shown in FIG. 18, and in a cavity of an existing crash barrier 190 in FIG. 19. In each case, it is possible to play with the parameters in such a manner that an effect is obtained which influences the behaviour of a traffic participant in a desired way.

Figure 20:
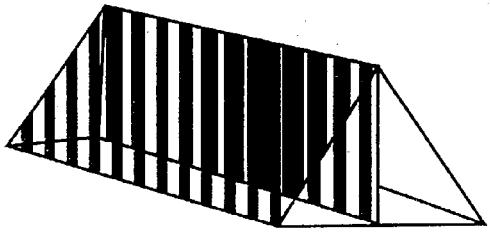
FIG. 20 shows a variant with front view obstacles which slope obliquely backwards.
Figure 20:
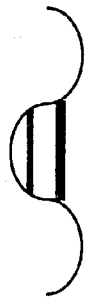
Figure 20:
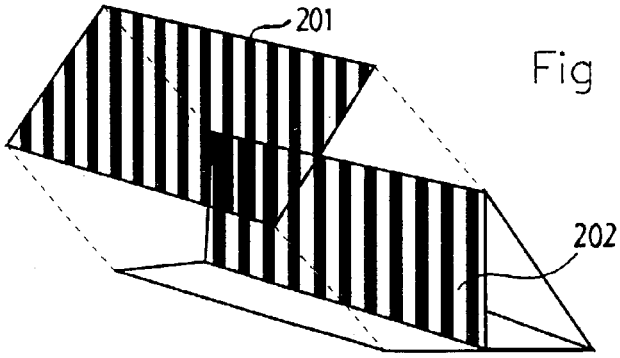

FIG. 20 shows a variant in which the first row of view obstacles 201 is inclined backwards with respect to the back row of vertical view obstacles 202. Moreover, the view obstacles 201 from the first row are inclined to the left. This variant is particularly advantageous on account of the stability which it provides. If, moreover, the assembly is of symmetrical design, i.e. in this variant two inclined rows of view obstacles with one row of vertical view obstacles positioned between them are provided, the assembly can preferably provide a desired visual effect on both sides simultaneously.

FIG. 21 shows a use of the invention on the walls of a tunnel in a bend. By suitably selecting parameters, a driver can be guided through the bend through the tunnel and can be induced to brake at the beginning of the tunnel.

In addition to being used on static objects, the invention can also be used on moving traffic objects, such as the back of a lorry (cf. FIG. 22) or the side of a car (cf. FIG. 23). In these cases too, the extent to which the attention of an observer passing the moving traffic object or being caught up by the traffic object is drawn is increased, thus improving the safety of both traffic participants.

Figure 24:
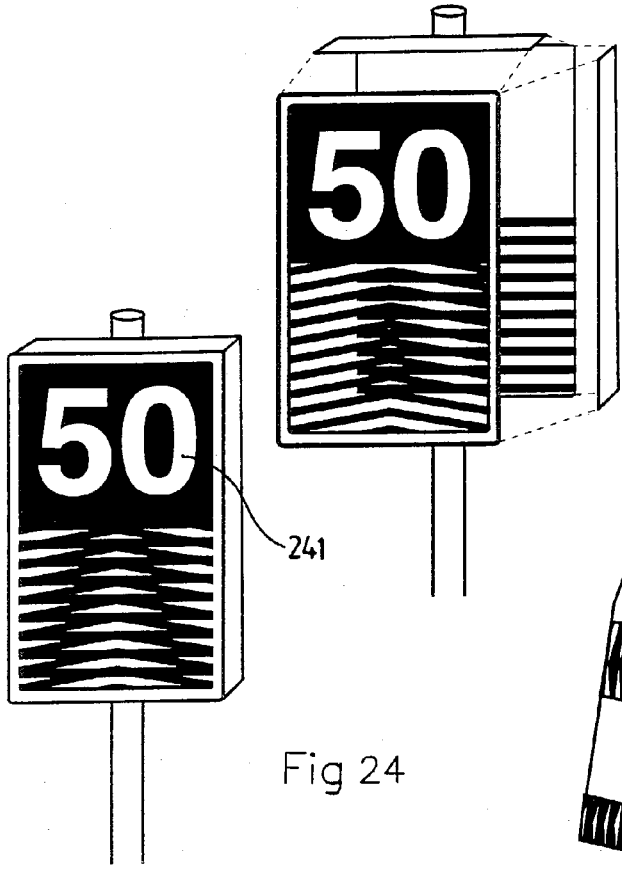
FIG. 24 shows a use in combination with a traffic sign.

FIG. 24 shows another advantageous use of the invention in combination with a traffic sign 241. The interference pattern which is produced ensures that all the attention of the traffic participant is focused onto the traffic sign 241. It is also possible for other types of messages which need to be conveyed, such as advertising, to be brought to the attention of the observer to an increased extent in this way.

Figure 25:
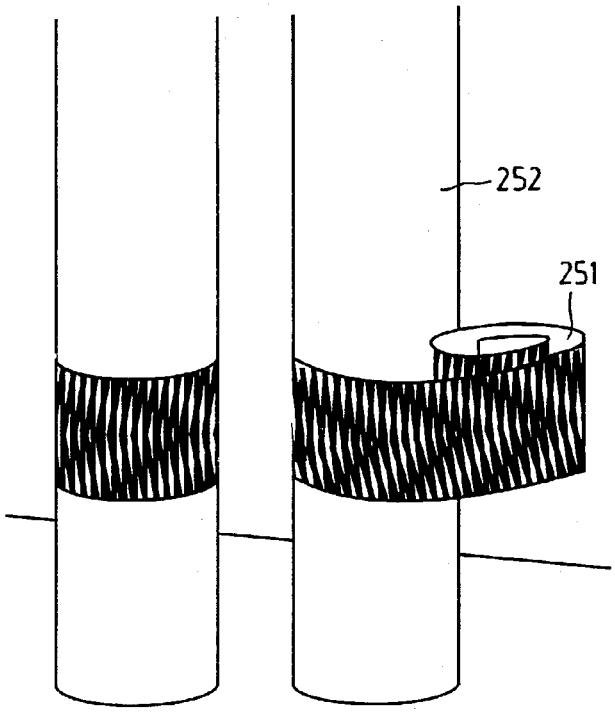
FIG. 25 shows a variant as a strip-like, flexible double-layer material.

FIG. 25 shows the use of the invention in a flexible strip-like material 251 which can be applied to any desired surface, for example a post 252 or a corner of a building. For this purpose, the strip of material is preferably provided, on the rear side, with a self-adhesive layer which is covered by a removable layer of film. To this end, the view obstacles in the first row comprise, for example, bent strips of dark material which are applied to a flexible, transparent, thin-walled support material. The view obstacles from the second row comprise, for example, strips of light material which are applied to a flexible, dark, thin-walled support material. The support materials are held at a distance from one another by means of preferably transparent spacers. In this context, it is pointed out that a space of only a few millimeters is quite sufficient to obtain the interference pattern according to the invention.

Figure 26:
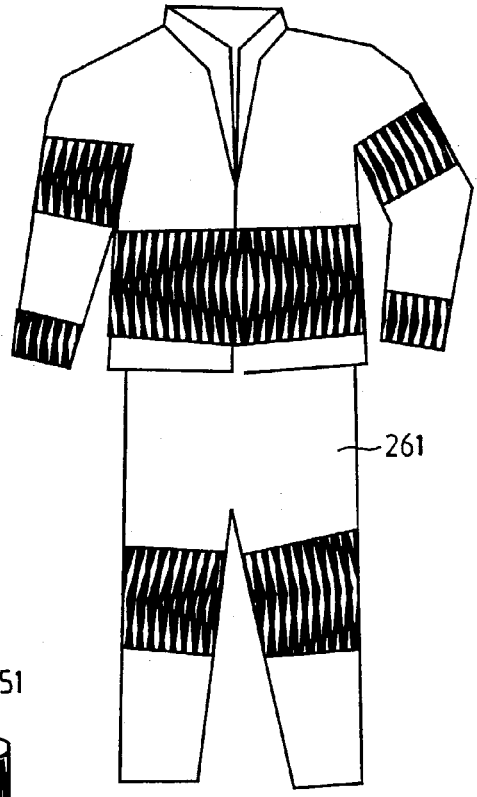
FIG. 26 shows a use in clothing.

The abovementioned thin-walled flexible design also makes the invention particularly suitable for use in clothing 261, for example in safety jackets for children and sportsmen, work clothing for roadworkers, etc. (cf. FIG. 26).

Figure 27:
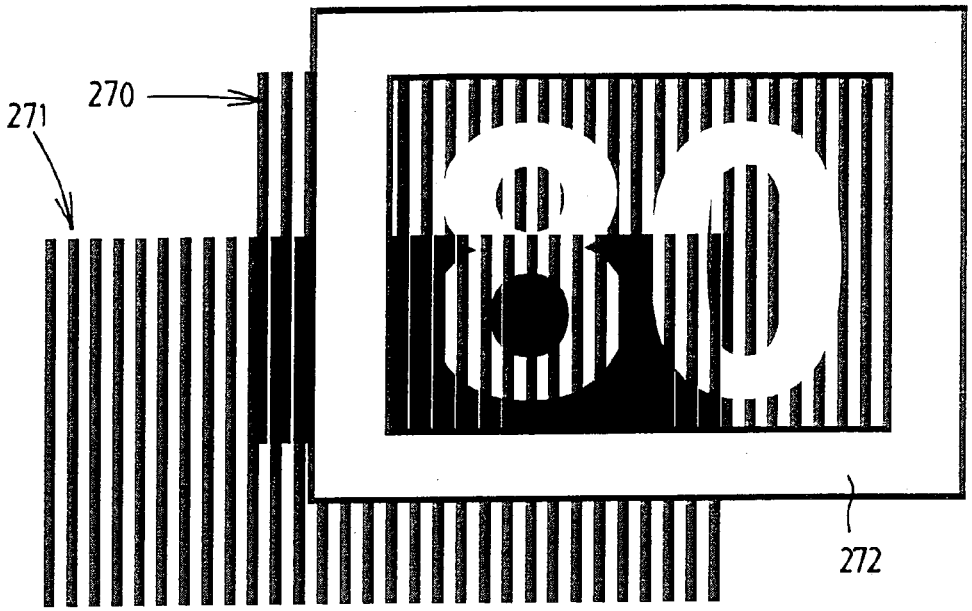
FIG. 27 shows a view with exploded parts of a variant with a message provided in the background.
Figure 28:
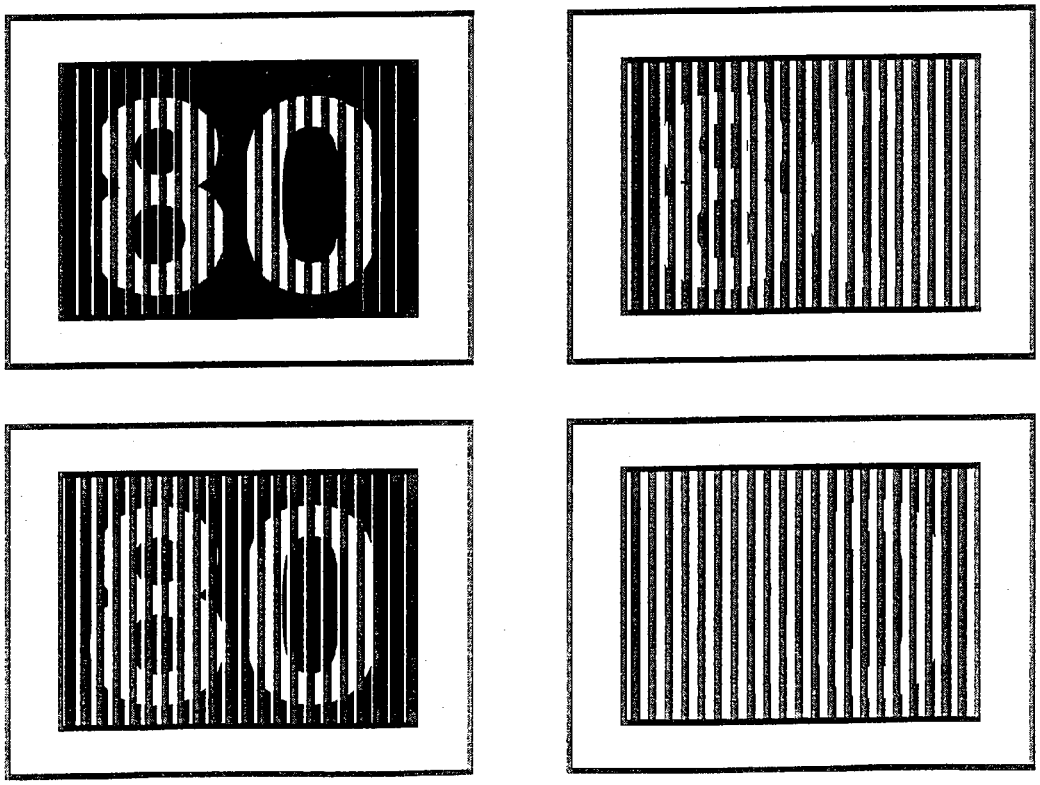
FIG. 28 shows successive images of the assembly from FIG. 27 as seen by an observer moving past it.

FIG. 27 shows an embodiment of an assembly in which a message, in this case the number 80, is provided in the background surfaces of a back row of view obstacles 270, in the colour of the view obstacles. A front row of view obstacles 271 is positioned over the back row of view obstacles, and this front row in turn is covered by a border 272. An observer moving past an assembly constructed in this way successively sees the four visual images from FIG. 28. A wave pattern of maxima and minima, as it were, moves over the message, which thus varies from being highly visible to being scarcely visible. In this way, the attention which it attracts is increased considerably. In a variant, the message may also be provided in the view obstacles of the back row, for example in the colour of the background.

In addition to the embodiment shown, numerous variants are possible. By playing with the distances between and widths of the view obstacles, the distances between the rows, different shapes of view obstacles, etc. it is possible in each case to make different, desired interference patterns visible.

For example, the front rows of view objects may also be formed by an elongate strip of material in which viewing openings are arranged. The back row of view obstacles may also be formed by contrast lines painted onto sheet-like material.

To increase the contrast, it is possible for reflective materials to be applied to the view obstacles, which can considerably increase the visibility of in particular the back row of view obstacles.

In a variant, the distance between the view objects in one or more rows is not constant, but rather is such that a moving interference pattern is formed. In this way, the attention of an approaching driver can be drawn to a dangerous situation which requires him to lower his speed.

The rows of view objects may be positioned along the road both in straight lines running parallel to the road and in straight lines which are at an angle to the road axis and in irregular, if desired wavy, lines.

Combinations of the above variants allowing very diverse interference patterns to be obtained are also conceivable. For example, if a plurality of back rows of view obstacles are provided, it is possible to achieve a very wide range of combination effects.

The marking assembly according to the invention may be positioned as an assembly of separate view objects, for example posts, along the road, but can also advantageously be used in a unit which can be positioned on its own. Consideration may be given to units of a few meters which are provided with support means on the underside. The support means are suitable, for example, for being pressed into a soft verge or for being secured to a specific type of crash barrier, for example by means of a click-fit connection.

Particularly with this latter variant, it is possible to react quickly to a dangerous situation which occurs suddenly.

It should be noted that the interference pattern is dependent on the angle between the lines of view from the field of view of the traffic participant and the rows of view obstacles. For angles which differ considerably from the direction at right angles to the rows of view obstacles, perspective distortion has to be taken into account. Otherwise, this distortion changes the wavelength of the interference pattern and the speed at which it moves with respect to the observer. For short rows of view obstacles, and for great distances between the rows and the observer, there is no need to take perspective distortion into account. For longer rows, perspective distortion is advantageously prevented by providing the view obstacles of the first row with depth as well as a specific width. This ensures that if the viewing angles are too great, the view of the back row or rows is lost altogether.

Therefore, the invention provides a marking assembly which can be used to display dynamic traffic indicators by means of a row of masking view obstacles, via which the attention of road users can be attracted easily and inexpensively and/or by means of which their driving can be influenced imperceptibly. The assembly is easy to use along existing roads and on existing traffic objects, without having an adverse effect on any traffic signalling means which are already present.

The invetion claimed is:

1. Marking assembly for marking particular traffic situations and objects, comprising:

a front sheet having viewing openings between parallel lines, a back sheet having parallel lines being situated further outwards, in a field of view of a traffic participant, than said front sheet, said front sheet parallel lines contrasting with respect to said back sheet parallel lines, wherein distances between said front sheet viewing openings between parallel lines and distances between said back sheet parallel lines are small in such a way that a plurality of viewing openings in said front sheet and a plurality of back sheet parallel lines lie within the field of view of the traffic participant, and that the field of view of said traffic participant at a particular instant offers a view, via the plurality of viewing openings in said front sheet, of an interference pattern of contrasting back sheet parallel lines, of at least one of said back sheet parallel lines , which are covered at least partially by said front sheet parallel lines.

2. Marking assembly according to claim 1, in which the distance between said front sheet parallel lines are unequal to the distance between said back sheet parallel lines.

3. Marking assembly according to claim 1, in which the widths of said front sheet parallel lines or said back sheet parallel lines are equal to the widths of said viewing openings in said front sheet.

4. Marking assembly according to claim 1, in which said front sheet parallel lines and said back sheet parallel lines are of slim, elongate design.

5. Marking assembly according to claim 1, in which said front sheet parallel lines and/or of at least one of said back sheet parallel lines extend at least partially obliquely with respect to the vertical in a plane which passes through the plurality of lines in said sheet in question.

6. Marking assembly according to claim 5, in which said front sheet parallel lines or said back sheet parallel lines are of bent design with respect to the vertical in a plane which passes through the plurality of front sheet parallel lines.

7. Marking assembly according to claim 1, in which said front sheet parallel lines or said back sheet parallel lines is provided with a border.

8. Marking assembly according to claim 1, in which one or more of said front sheet parallel lines or back sheet parallel lines are provided with reflective material.

9. Marking assembly according to claim 1, in which said front sheet parallel lines are covered by transparent material.

10. Marking assembly according to claim 1, in which said front sheet parallel lines are provided on flexible material having on the rear side, separated by a distance, a flexible material or flexible materials on which said back sheet parallel lines are provided.

11. Marking assembly according to claim 1, in which distances between said front sheet parallel lines are approximately 1% greater or smaller than distances between said back sheet parallel lines.

12. Marking assembly according to claim 1, wherein said front sheet parallel lines or said back sheet parallel lines have the identical design.

13. Marking assembly according to claim 1, wherein the heights of said front sheet parallel lines and said back sheet parallel lines are equal.

14. Marking assembly according to claim 1, wherein the widths of said front sheet parallel lines or said back sheet parallel lines are equal.

15. Marking assembly according to claim 1, wherein each of said front sheet parallel lines or said back sheet parallel lines has a longitudinal cross section shape and wherein said longitudinal cross section shape of said view front sheet parallel lines is unequal to said longitudinal cross section shape of said back sheet parallel lines.

16. Marking assembly according to claim 15, wherein said longitudinal cross section size of said front sheet parallel lines or said back sheet parallel lines is non-linear.

17. Marking assembly according to claim 1 wherein said front sheet parallel lines or said back sheet parallel lines are bent in the center.

18. Marking assembly according to claim 1 wherein said front sheet parallel lines or said back sheet parallel lines have the shape of an arrow.

19. Marking assembly according to claim 1, in which said interference pattern creates a flickering image.

20. Marking assembly according to claim 1, in which the width of said front sheet parallel lines and said back sheet parallel lines are independently variable.

21. Marking assembly according to claim 1, in which the width of said front sheet parallel lines and said back sheet parallel lines vary by approximately 1% to 5% percent.

22. Marking assembly according to claim 1, in which distances between said front sheet parallel lines are between approximately 1% and 5% greater or smaller than distances between said back sheet parallel lines.

* * * * *